US009327901B2

(12) United States Patent
Persellin

(10) Patent No.: US 9,327,901 B2
(45) Date of Patent: May 3, 2016

(54) MOUNTING ASSEMBLY FOR REFUSE CONTAINERS

(71) Applicant: Avi Persellin, Tucson, AZ (US)

(72) Inventor: Avi Persellin, Tucson, AZ (US)

( * ) Notice: Subject to any disclaimer, the term of this patent is extended or adjusted under 35 U.S.C. 154(b) by 0 days.

(21) Appl. No.: 14/245,891

(22) Filed: Apr. 4, 2014

(65) Prior Publication Data

US 2014/0299616 A1 Oct. 9, 2014

Related U.S. Application Data

(60) Provisional application No. 61/808,769, filed on Apr. 5, 2013.

(51) Int. Cl.
*B65F 1/14* (2006.01)

(52) U.S. Cl.
CPC ..... *B65F 1/141* (2013.01); *B65F 2210/18* (2013.01)

(58) Field of Classification Search
CPC ..... B65F 1/141; B65F 2210/18
USPC ..... 220/481, 737, 482, 751; 248/222.11, 248/225.21, 309.1, 311.2
See application file for complete search history.

(56) References Cited

U.S. PATENT DOCUMENTS 3,248,765 A * 5/1966 Achabal et al. ..... 248/222.11
3,508,691 A * 4/1970 Langbehn ..... 224/248

FOREIGN PATENT DOCUMENTS

GB 1076475 * 7/1967 ..... A47G 29/00

* cited by examiner

*Primary Examiner* — Fenn Mathew
*Assistant Examiner* — Elizabeth Volz
(74) *Attorney, Agent, or Firm* — Grossman Tucker Perreault & Pfleger PLLC

(57) ABSTRACT

A mounting assembly to support a refuse container and mount the refuse container to a variety of objects. The mounting assembly includes a body portion extending along a first plane between a first end and a second end of the mounting assembly, a mounting portion extending along a second plane outwardly from the first plane, the mounting portion configured to be secured to a fixture, one or more support members at the first end of the mounting assembly, each of the one or more support members configured to couple to a corresponding portion of the container; and a retaining member at the second end of the mounting assembly, the retaining member configured to retain a fastening member that is to extend around at least a portion of an exterior perimeter of the container.

18 Claims, 6 Drawing Sheets

MOUNTING ASSEMBLY FOR REFUSE CONTAINERS

CROSS REFERENCE TO RELATED APPLICATIONS

This application claims the benefit of U.S. Provisional Patent Application Ser. No. 61/808,769, filed on Apr. 5, 2013, all of which is fully incorporated herein by reference.

FIELD

The present disclosure relates generally to mounting containers for waste materials, and, more particularly, to a mounting assembly for mounting a refuse container to a variety of objects.

BACKGROUND

Waste management, including the amount, as well as collection, of waste materials, continues to be an ever-growing problem. This is especially true in consumer sectors where a large amount of refuse is discarded on a daily basis. Many consumers have trash bins for collecting trash generated in or around the home. As a result, the contents of the trash bins may be collected or disposed of on a regular basis, for example, by waste management companies, which may include curb-side pickup.

However, in certain settings, the collection of refuse may be difficult. For instance, when outdoors, a person may not take the time to properly dispose of refuse in a trash bin because, for example, a trash bin may not be conveniently located nearby. Consequently, this may result in the littering, which may ultimately pollute the environment.

BRIEF DESCRIPTION OF THE DRAWINGS

Features and advantages of the claimed subject matter will be apparent from the following detailed description of some example embodiments consistent therewith, which description should be considered with reference to the accompanying drawings, wherein:

DETAILED DESCRIPTION

The present disclosure is generally directed to a mounting assembly configured to support a refuse container and mount the refuse container to a variety of objects. The mounting assembly generally includes a body having a first end and an opposing second end and a mounting bracket extending away from a portion of the body between the first and second ends. The mounting bracket is configured to be securely coupled to a fixture. The first end may be generally defined by one or more discrete support members, wherein each discrete support member is configured to engage a corresponding portion of the refuse container. In one example embodiment, the refuse container may include a handle having one or more discrete recessed portions, wherein each of the recessed portions is shaped and/or sized to receive a corresponding one of the discrete support members of the first end of the mounting assembly, thereby securing the refuse container to the mounting assembly. The second end of the body of the mounting assembly includes a retaining member configured to retain a fastening member extending around an entire outer periphery of the refuse container when the refuse container is coupled to the mounting assembly.

A mounting assembly consistent with the present disclosure generally provides a means of securing a refuse container to fixtures having horizontal and/or vertical positions, including, but not limited to, railings, horizontal posts, terraces, porches, gates, decks, and balconies. Example embodiments disclosed herein may be particularly useful on a pier or dock, where it may be advantageous to have a refuse container in a location where people may be prone to littering due to the remoteness of the setting, i.e. open water. A mounting assembly consistent with the present disclosure may provide improved access and convenience for a person to properly dispose of refuse, including recyclable and/or non-recyclable waste materials, thereby improving waste management.

Figure 1:
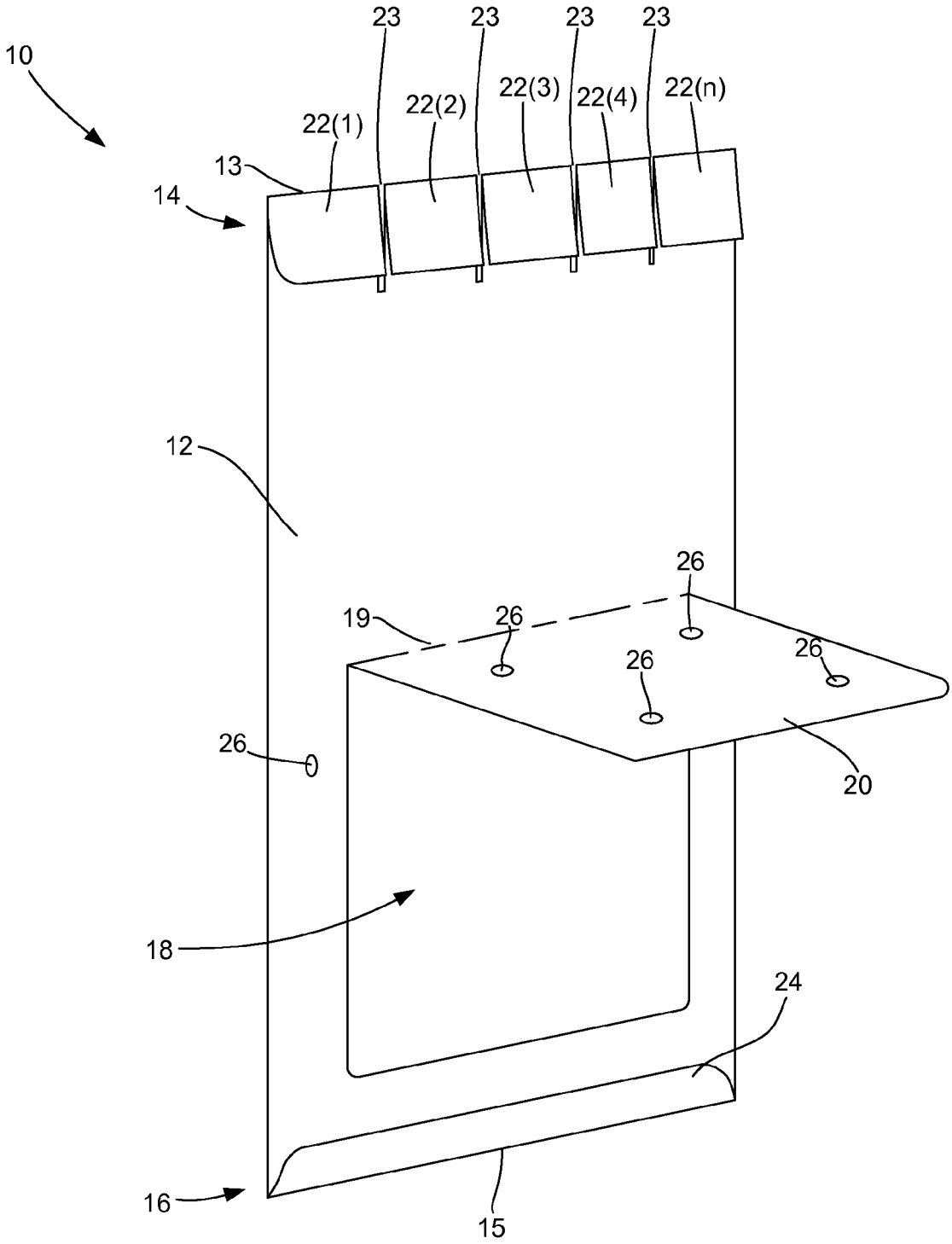
FIG. 1 is a perspective view of a mounting assembly consistent with the present disclosure.
Figure 2:
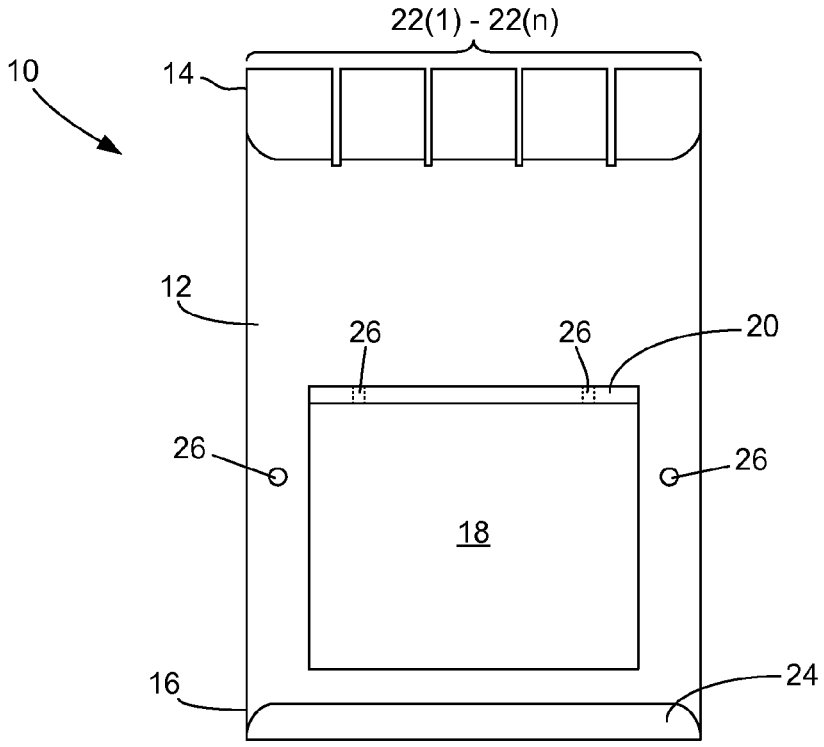
FIGS. 2-3 are front and side views of the mounting assembly of FIG. 1.
Figure 3:
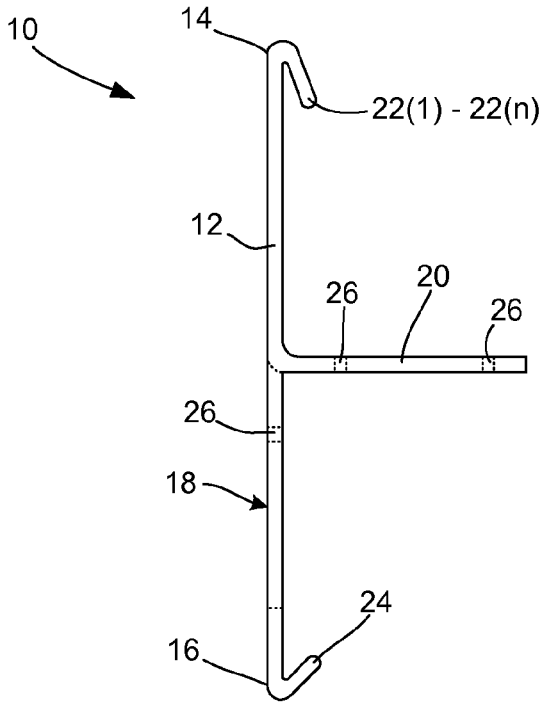

Turning now to the drawings, FIG. 1 is a perspective view of a mounting assembly 10 consistent with the present disclosure and FIGS. 2 and 3 are front and side views of the mounting assembly 10 of FIG. 1. It should be noted that internal features and/or surfaces are illustrated in phantom in FIGS. 2 and 3. In the illustrated example embodiment, the mounting assembly 10 may be a one-piece or monolithic structure including a body 12, the body 12 having a first end 14 including a first bend 13 and an opposing second end 16 including a second bend 15, and a mounting bracket 20 including a third bend 19. While the body 12 and the mounting bracket 20 are each portions of the mounting assembly 10, the body 12 may be oriented along a first plane, with at least a portion of the body 12 extending between the first end 14 and the second end 16 on the first plane, while the mounting bracket 20 may extend outwardly from the first plane along a second plane. In the example embodiment illustrated in FIG. 1, the mounting bracket 20 is formed from a portion of the body 12, wherein the mounting bracket 20 is bent along the third bend 19 into a general L-shaped configuration in relation to the first plane, thereby resulting in an aperture 18 formed in a portion of the body 12 along the first plane. As such, the body 12 and mounting bracket 20 are of a single unitary construction.

As examples of single unitary construction, the mounting assembly 10 may be formed in a mold or stamped out of a planar sheet of material and formed without welds. However, example embodiments may vary and the mounting assembly 10 may be plastic, fiber reinforced plastics (e.g. composites), metal or any other material known by one of skill in the art and may be formed in any process known by one of skill in the art.

As the mounting bracket 20 may be formed by bending a portion of the body 12, a size and/or shape of the aperture 18 may be based on a size and/or shape of the mounting bracket 20 removed from the body 12. For example, the size of the aperture 18 may be identical to the size of the mounting bracket 20. However, example embodiments may vary and the size of the aperture 18 may instead be larger than the size of the mounting bracket 20. Alternatively, some example embodiments may not include the aperture 18, depending on the molding process.

In the example embodiment illustrated in FIG. 1, the mounting bracket 20 is substantially perpendicular to the first plane. However, it should be noted that example embodiments may vary and the mounting bracket 20 may include any desired shape and may be positioned at a variety of angles relative to the first plane depending on the exterior shape and configuration of the fixture to which the mounting bracket 20 is to be secured. As used herein, substantially perpendicular indicates that the first plane and the second plane diverge at a 90 degree angle, plus or minus 10 degrees. For example, the first plane may be substantially vertical (90 degrees plus or minus 10 degrees) and the second plane may be substantially horizontal (0 degrees plus or minus 10 degrees). However, if the mounting assembly 10 is mounted so that the first plane is oriented substantially vertically, the second plane may diverge from the first plane at any angle between 0 and 180 based on the angle of the fixture.

In the illustrated example embodiment, the first end 14 of the body 12 includes the first bend 13 and one or more discrete support members 22(1)-22(*n*) (hereinafter referred to as "support members 22" for ease of description), which may be separated by slots 23 cut into the first end 14 and possibly a portion of the body 12. The slots 23 may be formed between each of the support members 22 to separate the support members 22, and a depth of the slots 23 may vary. For example, the slots 23 may extend past the first end 14 and a desired distance into the body 12, or the slots 23 may extend only partially through the first end 14. As described in greater detail herein, each of the support members 22, in conjunctions with the slots 23, may be configured to engage and retain a corresponding portion of a refuse container 28 (shown in FIG. 5), thereby securing the refuse container 28 to the mounting assembly 10.

In the illustrated example embodiment, the second end 16 of the body 12 includes the second bend 15 and a retaining member 24 configured to retain a fastening member 36 (shown in FIG. 5) to the refuse container 28, thereby further ensuring that the refuse container 28 remains coupled to the mounting assembly 10. The retaining member 24 may also be configured to retain the fastening member 36 to the mounting assembly 10 when the refuse container 28 is not attached to the mounting assembly 10, allowing the fastening member 36 to be reused and reducing the number of replacements required.

The mounting assembly 10 is configured to be securely coupled to a fixture. As shown, the mounting bracket 20 includes apertures 26 for receiving fasteners to secure the mounting bracket 20 to a fixture. Similarly, the body 12 may also include apertures 26 for receiving fasteners to secure the body 12 to a fixture. However, not all apertures 26 are required to securely couple the mounting assembly 10 to the fixture. For example, if the fixture is not substantially horizontal but the body 12 is to be oriented substantially vertically, the mounting bracket 20 may be securely coupled to the fixture at an angle to the first plane using the apertures 26 in the mounting bracket 20 but not the apertures located in the body 12. Therefore, example embodiments are not limited to the example illustrated in FIG. 1 and the number and location of apertures 26 may vary depending on the exterior shape and configuration of the fixture to which the mounting assembly 10 is to be secured.

The body 12 of the mounting assembly 10 may have two faces pointing in opposite directions. The first face of the body 12 faces the mounting bracket 20 and the fixture, while the second face of the body 12 faces the refuse container 28. Beyond the first bend 13, the support members 22 bend away from the body 12 in the direction of the mounting bracket 20 and the fixture, overlapping a portion of the first face of the body 12. Similarly, beyond the second bend 15 the retaining member 24 bends away from the body 12 in the direction of the mounting bracket 20 and the fixture, overlapping a portion of the first face of the body 12. Thus, both the support members 22 and the retaining member 24 overlap portions of the first face, whereas the second face comprises a single plane and is configured to abut the refuse container 28.

Figure 4:
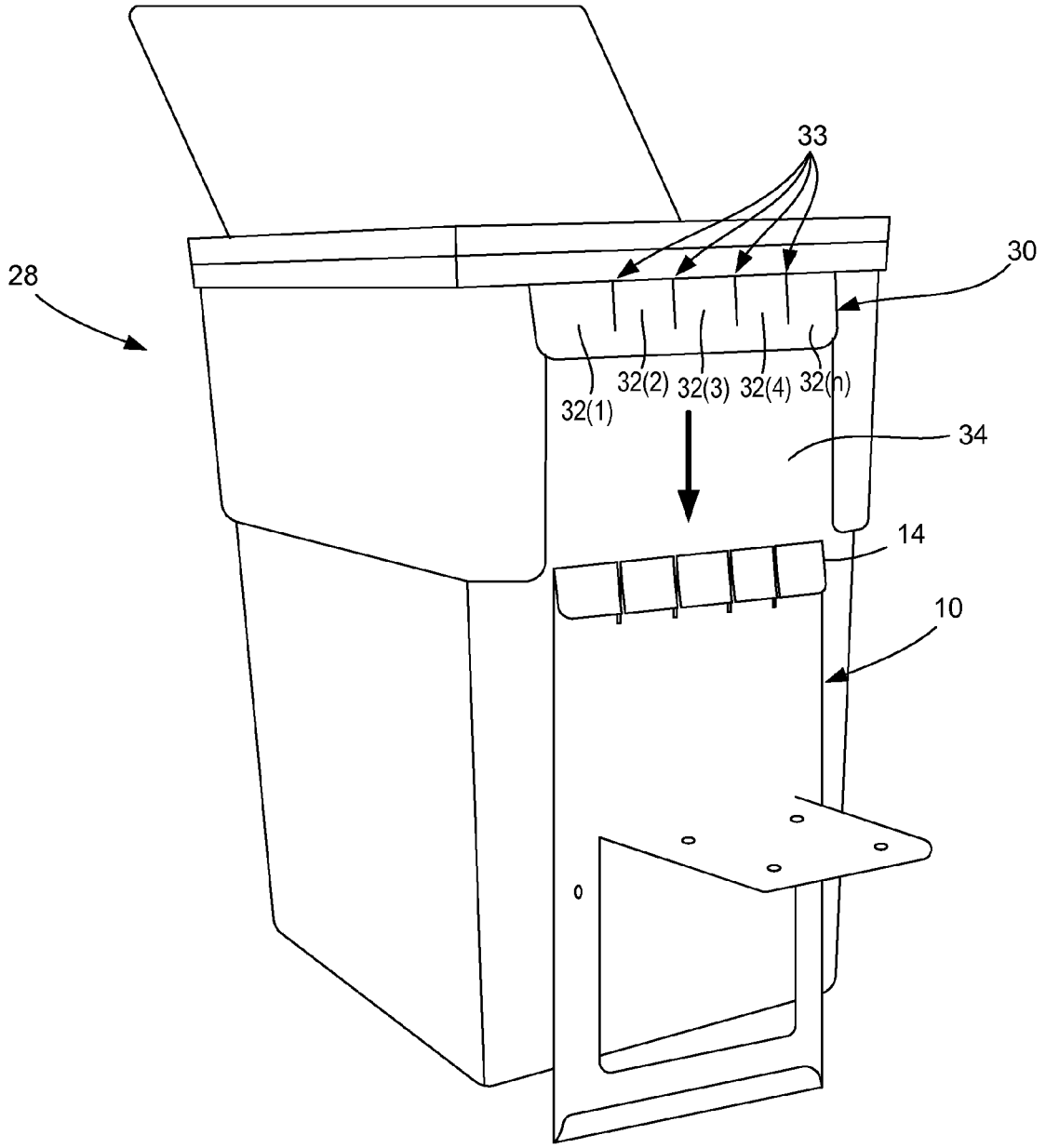
FIGS. 4 and 5 are perspective views illustrating a refuse container separated from and coupled to the mounting assembly of FIG. 1, respectively.
Figure 5:
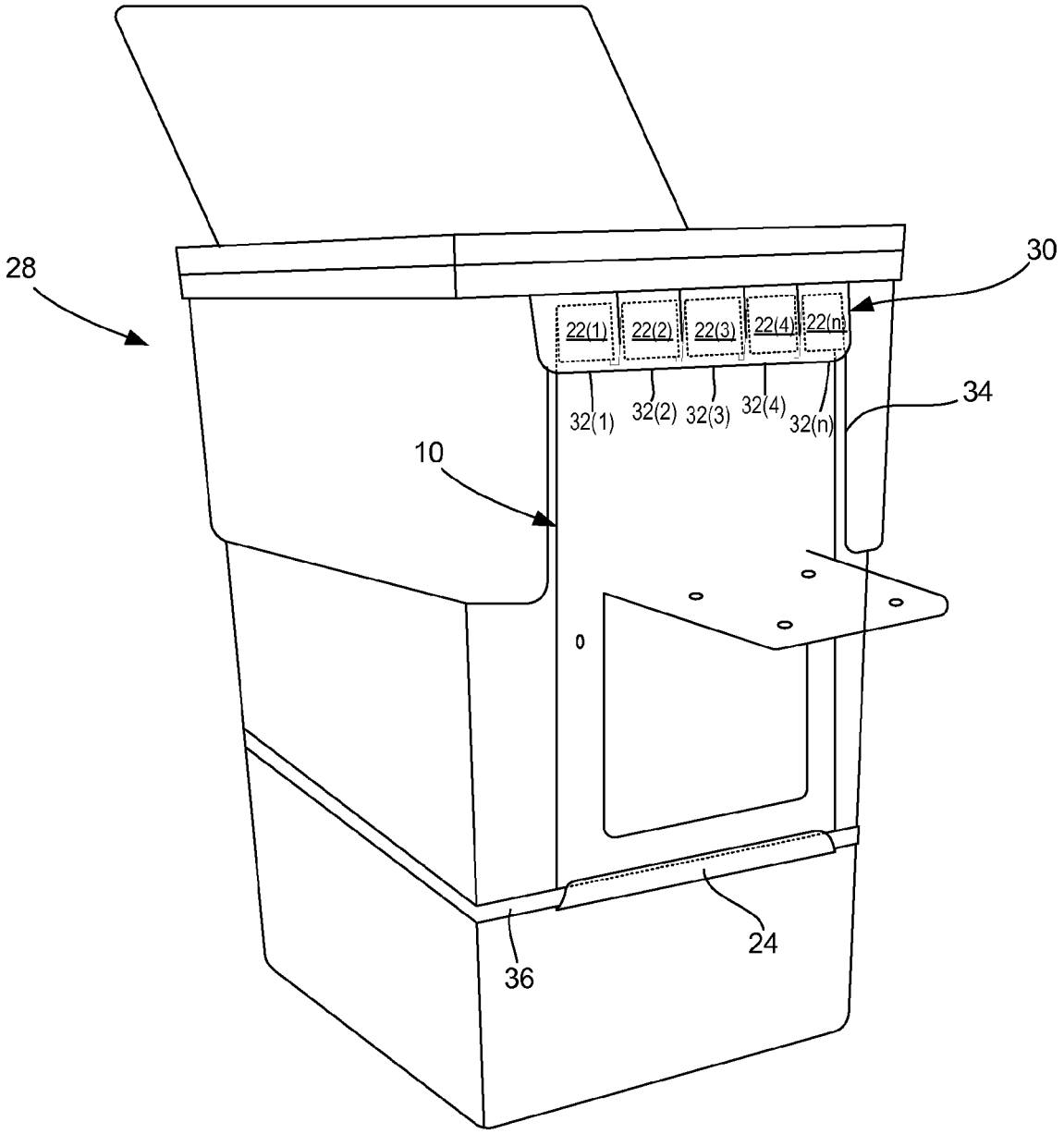

FIGS. 4 and 5 illustrate perspective views of a refuse container 28 separated from and coupled to the mounting assembly 10 of FIG. 1, respectively. As shown, the refuse container 28 may generally include a body having a base and walls extending upwardly and away from the base, generally extending along the entire periphery of the base, thereby forming a cavity for receiving and storing refuse. As shown, the walls are solid. It should be noted that, in other example embodiments, one or more walls may include apertures (not shown) defined therein. The refuse container 28 may further include a lid configured to be coupled to the body at or near a rim portion of the walls.

As shown, the refuse container 28 further includes at least one handle 30 having one or more discrete recessed portions 32(1)-32(*n*) (hereinafter generally referred to as "recessed portions 32" for ease of description), which may be separated by ridges 33. As described in greater detail herein, one or more of the recessed portions 32 may be configured to cooperatively couple with a corresponding one of the support members 22 of the first end 14 of the mounting assembly 10 to allow the refuse container 28 to be securely coupled to the mounting assembly 10. While coupling the support members 22 to the recessed portions 32, the ridges 33 may be aligned with the slots 23, assisting in aligning the refuse container 28 on the mounting assembly 10 and providing lateral support for the refuse container 28.

The refuse container 28 may also include an indentation 34 formed adjacent to the handle 30 and generally extending towards the base of the refuse container 28. The indentation 34 may be configured to limit movement of the body 12 in a lateral direction relative to the handle 30 and may potentially assist in guiding the refuse container 28 onto the mounting assembly 10 prior to coupling the recessed portions 32 and the support members 22. As another example, the indentation 34 may reduce the likelihood of the recessed portions 32 and the support members 22 becoming uncoupled due to a lateral force on the refuse container 28. However, example embodiments are not limited thereto and the indentation 34 may not contact the mounting assembly 10.

FIG. 4 illustrates the refuse container 28 separated from the mounting assembly 10. When a user wishes to couple the refuse container 28 to the mounting assembly 10, the user need only position the first end 14 of the mounting assembly 10 into the handle 30 of the refuse container 28, as indicated by the arrow. The slots 23 in the mounting assembly 10 and the ridges 33 and indentation 34 of the refuse container 28 may assist the user in positioning the first end 14 of the mounting assembly 10 into the handle 30 of the refuse container 28. Generally, the mounting assembly 10 will be securely coupled to a fixture (e.g. a post, fence, etc.) prior to the coupling of the refuse container 28 thereto. Accordingly, the user need only position the refuse container 28, specifically the handle 30 of the refuse container 28, over the exposed first end 14 of the mounting assembly 10, and allow the first end 14 to slide into the handle 30, as indicated by the arrow.

FIG. 5 illustrates the refuse container 28 coupled to the mounting assembly 10. As shown, the refuse container 28 is coupled to the mounting assembly 10 by way of the support members 22(1)-22(*n*) of the first end 14 of the mounting assembly 10 and the recessed portions 32(1)-32(*n*) of the handle 30. More specifically, each of the recessed portions 32 of the handle 30 is shaped and/or sized to receive a corresponding one of the support members 22 of the first end 14 of the mounting assembly 10. Upon placing the refuse container 28 onto the mounting assembly 10, each of the support members 22 is configured to slide into a corresponding one of the recessed portions 32, thereby securing the refuse container 28 to the mounting assembly. Lateral support may be provided by the ridges 33 in the handle 30 that may reduce the likelihood of the recessed portions 32 and the support members 22 becoming uncoupled due to a lateral force on the refuse container 28. Furthermore, the indentation 34 of the refuse container 28 may be shaped and/or sized to receive a portion of the body 12 of the mounting assembly 10 within and may also provide lateral support. For example, the indentation 34 may be shaped and/or sized to contact an edge of the body 12 of the mounting assembly 10, or the indentation 34 may be shaped and/or sized to overlap a portion of the body 12 of the mounting assembly 10. In one example embodiment, the refuse container 28 may include a commercially available container sold under the trade designation EZ STOR® Container with Hinged Cover offered by LINPAC Ropak Packaging (Fountain Valley, Calif.).

As shown, the refuse container 28 may be further secured to the mounting assembly 10 by way of a fastening member 36. The fastening member 36 may generally extend around the entire exterior perimeter of the body of the refuse container 28. For example, the fastening member 36 may be a retaining strap and may form a closed loop with the retaining member 24 to allow the fastening member 36 to quickly disengage from the refuse container 28. As previously described, the fastening member 36 may be retained by the retaining member 24 of the second end 16 of the mounting assembly 10. In particular, the retaining member 24 be shaped and/or sized to accommodate the fastening member 36 and to prevent the fastening member 36 from shifting, e.g. riding up and/or down a length of the refuse container 28, when the refuse container 28 is coupled to the mounting assembly 10. For example, the retaining member 24 may be shaped and/or sized to allow an upward movement of the fastening member 36 but prevent a downward movement of the fastening member 36, or the retaining member 24 may be shaped and/or sized to prevent both the upward and the downward movement of the fastening member 36. In addition, the retaining member 24 may also be configured to retain the fastening member 36 to the mounting assembly 10 when the refuse container 28 is not attached to the mounting assembly 10, allowing the fastening member 36 to be reused and reducing the number of replacements required.

The fastening member 36 may include a generally durable, flexible and resilient material. For example, in one example embodiment, the fastening member 36 may include an elastic material, such as, for example, a band configured to elastically conform to the shape of the refuse container 28 and apply a pressure against the refuse container 28. In one example embodiment, the fastening member 36 may include a commercially available band sold under the trade designation EPDM Industrial All-Weather Band by Alliance Rubber Company (Hot Springs, Ariz.). In other example embodiments, the fastening member 36 may include other known fastening devices, such as cable tie, rope or cord having hook and loop, buckle, clasp, bungee cord, etc.

Figure 6A:
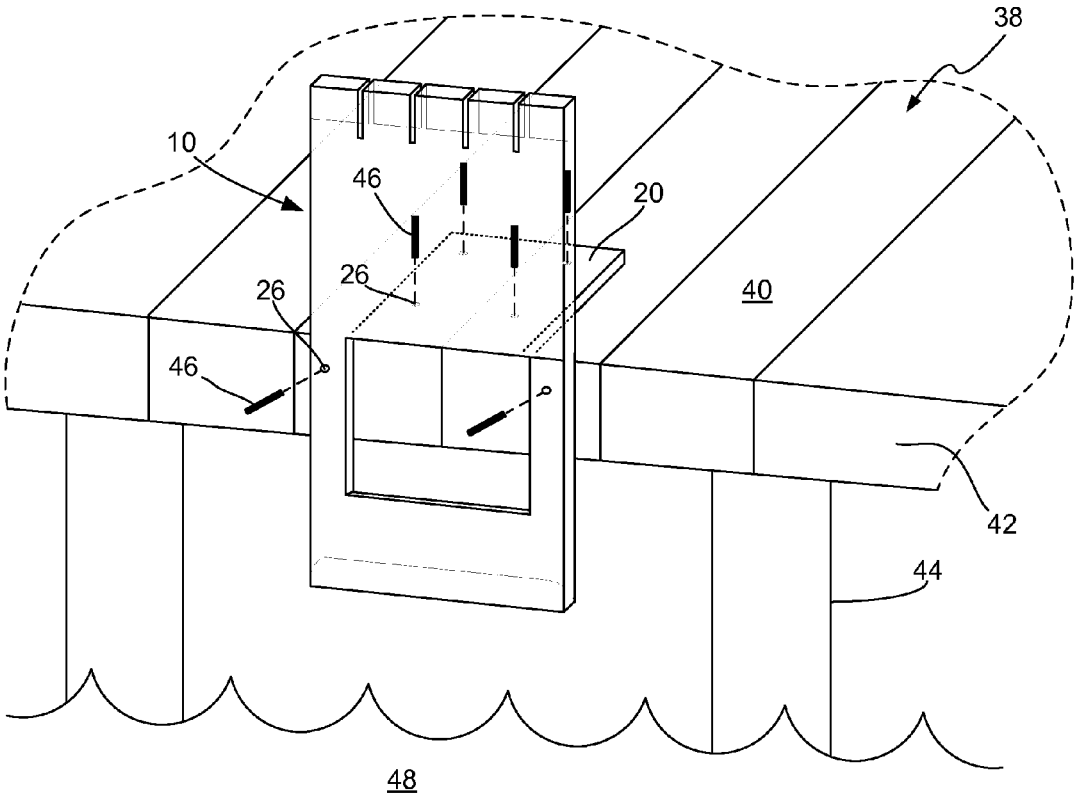
FIG. 6A is a perspective view of the mounting assembly of FIG. 1 fixed to a pier.
Figure 6B:
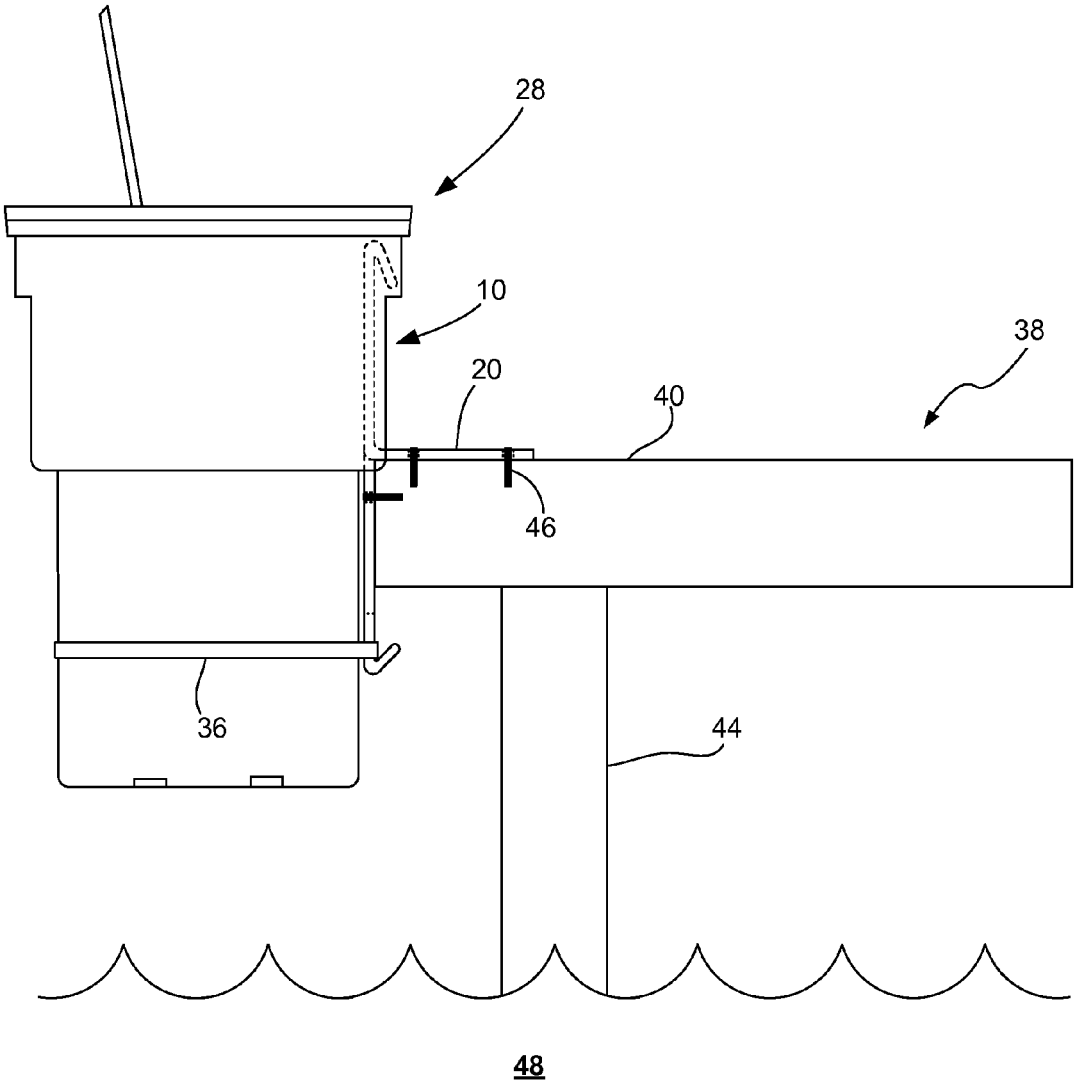
FIG. 6B is a side view of the refuse container coupled to the mounting assembly fixed to the pier shown in FIG. 6A.

FIG. 6A is a perspective view of the mounting assembly 10 secured to a fixture and FIG. 6B is a side view of the refuse container 28 coupled to the mounting assembly 10 secured to the fixture. For purposes of clarity, the fixture will be described as being a pier or a dock 38 onto which the mounting assembly 10 and, ultimately, the refuse container 28, are attached. As shown, the pier 38 includes an upper surface, e.g deck 40, and an outer surface, e.g. edge of deck 42. The pier 38 may also commonly contain a plurality of pilings or structural members 44 to support the deck 40 above a surface of water 48. As previously described, the mounting assembly 10 may be secured to the pier 38. In the illustrated example embodiment, the mounting bracket 20 may be secured to a portion of the deck 40 and a portion of the body 12 may be secured to the edge of the deck 42 via fasteners 46. The fasteners 46 may include, for example, screws, nails, bolts, and the like. The fasteners 46 pass through at least some of the apertures 26 defined in the mounting bracket 20 and body 12 of the mounting assembly 10 and are driven into the deck 40 and edge of the deck 42, respectively, thereby securing the mounting assembly 10 to the pier 38.

FIG. 6B is a side view, partly in section, of the mounting assembly 10 secured to the pier 38 and the refuse container 28 coupled to the mounting assembly 10. The refuse container 28 is coupled to the mounting assembly 10 at least by way of the cooperative engagement of the support members 22 of the first end 14 of the mounting assembly 10 with the corresponding recessed portions 32 of the handle 30 of the refuse container 28. Additionally, the refuse container 28 is further secured to the mounting assembly 10 by way of the fastening member 36.

According to some example embodiments, a mounting assembly to support a container may include a body portion extending along a first plane between a first end and a second end of the mounting assembly; a mounting portion extending along a second plane outwardly from the first plane, the mounting portion configured to be secured to a fixture; one or more support members at the first end of the mounting assembly, each of the one or more support members configured to couple to a corresponding portion of the container; and a retaining member at the second end of the mounting assembly, the retaining member configured to retain a fastening member that is to extend around at least a portion of an exterior perimeter of the container.

The mounting assembly may be a monolithic structure.

The mounting portion may be formed by bending a portion of the body portion outwardly from the first plane, causing an aperture in the body portion along the first plane.

The mounting portion may be substantially perpendicular to the body portion.

The one or more support members may be separated by slots in the first end of the mounting assembly.

The one or more support members may be formed by bending a portion of the body portion towards the second end of the mounting assembly, so that the one or more support members overlap a portion of the body portion.

The mounting assembly may include a first bend between the body portion and the one or more support members; a second bend between the body portion and the retaining member; and a third bend between the body portion and the mounting portion.

The one or more support members, the retaining member and the mounting portion may extend from the first plane away from the container.

The body portion and the mounting portion may include one or more apertures configured to secure the mounting assembly to the fixture.

The body portion may be configured to be secured to the fixture.

According to some example embodiments, a system may include a container including, a body having a base and walls extending upwardly and away from the base to form a cavity for receiving and storing refuse; and at least one handle having one or more recessed portions; and a mounting assembly configured to support the container, the mounting assembly including, a body portion extending along a first plane between a first end and a second end of the mounting assembly; a mounting portion extending along a second plane outwardly from the first plane, the mounting portion configured to be secured to a fixture; one or more support members at the first end of the mounting assembly, each of the one or more support members configured to couple to a corresponding one the one or more recessed portions of the container; and a retaining member at the second end of the mounting assembly, the retaining member configured to retain a fastening member that is to extend around at least a portion of an exterior perimeter of the container.

The mounting portion may be formed by bending a portion of the body portion outwardly from the first plane, causing an aperture in the body portion along the first plane.

The system may include the fastening member configured to secure the container to the mounting assembly, the fastening member extending around the entire exterior perimeter of the container.

The container may include a lid configured to be coupled to the body at or near a rim portion of the walls.

The one or more recessed portions of the at least one handle may be separated by ridges, and the one or more support members of the mounting assembly may be separated by slots, and the ridges may be aligned with the slots to couple the container to the mounting assembly.

The container may include an indentation adjacent to the at least one handle and extending towards the base of the container, the indentation overlapping a portion of the body portion.

The mounting assembly may be a monolithic structure.

The mounting portion may be substantially perpendicular to the body portion.

The mounting assembly may include a first bend between the body portion and the one or more support members; a second bend between the body portion and the retaining member; and a third bend between the body portion and the mounting portion.

The one or more support members, the retaining member and the mounting portion may extend from the first plane away from the container.

While several example embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant only as examples and that the actual parameters, dimensions, materials, and/or configurations will depend upon the specific application or applications for which the teachings of the present disclosure is/are used. Those skilled in the art will recognize, or be able to ascertain using no more than routine experimentation, many equivalents to the specific example embodiments of the disclosure described herein.

It is, therefore, to be understood that the foregoing example embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A mounting assembly to support a container, the mounting assembly comprising:

a body portion extending along a planar member having a first side and a second side, the planar member extending between a first end and a second end of the mounting assembly;

a mounting portion extending along a second plane outwardly from the first plane, the mounting portion configured to be secured to a fixture;

one or more support members at the first end of the mounting assembly, each of the one or more support members configured to couple to a corresponding portion of the container; and a retaining member at the second end of the mounting assembly, the retaining member configured to retain a fastening member that is to extend around at least a portion of an exterior perimeter of the container;

wherein the one or more support members, the retaining member, and the mounting portion extend from the first side of the planar member, away from the container.

2. The mounting assembly of claim 1, wherein the mounting assembly is a monolithic structure.

3. The mounting assembly of claim 1, wherein the mounting portion is formed by bending a portion of the body portion outwardly from the planar member, causing an aperture in the body portion along the planar member.

4. The mounting assembly of claim 1, wherein the mounting portion is substantially perpendicular to the body portion.

5. The mounting assembly of claim 1, wherein the one or more support members are separated by slots in the first end of the mounting assembly.

6. The mounting assembly of claim 1, wherein the one or more support members are formed by bending a portion of the body portion towards the second end of the mounting assembly, so that the one or more support members overlap a portion of the body portion.

7. The mounting assembly of claim 1, further comprising:

a first bend between the body portion and the one or more support members;

a second bend between the body portion and the retaining member; and a third bend between the body portion and the mounting portion.

8. The mounting assembly of claim 1, wherein the body portion and the mounting portion include one or more apertures configured to secure the mounting assembly to the fixture.

9. The mounting assembly of claim 8, wherein the body portion is configured to be secured to the fixture.

10. A system, the system comprising:

a container including, a body having a base and walls extending upwardly and away from the base to form a cavity for receiving and storing refuse; and at least one handle having one or more recessed portions; and a mounting assembly configured to support the container, the mounting assembly including, a body portion extending along a planar member having a first side and a second side, the planar member extending between a first end and a second end of the mounting assembly;

a mounting portion extending along a second plane outwardly from the first plane, the mounting portion configured to be secured to a fixture;

one or more support members at the first end of the mounting assembly, each of the one or more support members configured to couple to a corresponding one of the one or more recessed portions of the container; and a retaining member at the second end of the mounting assembly, the retaining member configured to retain a fastening member that is to extend around at least a portion of an exterior perimeter of the container;

wherein the one or more support members, the retaining member, and the mounting portion extend from the first side of the planar member, away from the container.

11. The system of claim 10, wherein the mounting portion is formed by bending a portion of the body portion outwardly from the planar member, causing an aperture in the body portion along the planar member.

12. The system of claim 10, further comprising:

a fastening member configured to secure the container to the mounting assembly, the fastening member extending around the entire exterior perimeter of the container.

13. The system of claim 10, wherein the container further comprises:

a lid configured to be coupled to the body at or near a rim portion of the walls.

14. The system of claim 10, wherein the handle includes a plurality of recessed portions, each of the plurality of recessed portions of the at least one handle separated by a ridge, and the first end of the mounting assembly includes a plurality of support members, each of the support members separated by a slot, and the ridges are aligned with the slots to couple the container to the mounting assembly.

15. The system of claim 10, wherein the container further comprises:

an indentation adjacent to the at least one handle and extending towards the base of the container, the indentation overlapping a portion of the body portion.

16. The system of claim 10, wherein the mounting assembly is a monolithic structure.

17. The system of claim 10, wherein the mounting portion is substantially perpendicular to the body portion.

18. The system of claim 10, wherein the mounting assembly further comprises:

a first bend between the body portion and the one or more support members;

a second bend between the body portion and the retaining member; and a third bend between the body portion and the mounting portion.

* * * * *